US007603068B2

(12) United States Patent
Tsueda et al.

(10) Patent No.: US 7,603,068 B2
(45) Date of Patent: Oct. 13, 2009

(54) FIXING APPARATUS FOR FORMING AN IMAGE

(75) Inventors: Yoshinori Tsueda, Fuji (JP); Satoshi Kinouchi, Tokyo (JP); Osamu Takagi, Chofu (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 448 days.

(21) Appl. No.: 11/416,065

(22) Filed: May 3, 2006

(65) Prior Publication Data

US 2007/0258740 A1 Nov. 8, 2007

(51) Int. Cl.
*G03G 15/20* (2006.01)

(52) U.S. Cl. ..... 399/328; 399/320; 399/333

(58) Field of Classification Search ..... 399/320, 399/328, 333
See application file for complete search history.

(56) References Cited

U.S. PATENT DOCUMENTS

| | | | |
|---|---|---|---|
| 6,026,273 | A | 2/2000 | Kinouchi et al. |
| 6,078,781 | A | 6/2000 | Takagi et al. |
| 6,087,641 | A | 7/2000 | Kinouchi et al. |
| 6,337,969 | B1 | 1/2002 | Takagi et al. |
| 6,438,335 | B1 | 8/2002 | Kinouchi et al. |
| 6,643,476 | B1 | 11/2003 | Kinouchi et al. |
| 6,724,999 | B2 | 4/2004 | Kikuchi et al. |
| 6,725,000 | B2 | 4/2004 | Takagi et al. |
| 6,763,206 | B2 | 7/2004 | Kinouchi et al. |
| 6,861,627 | B2 | 3/2005 | Wasai et al. |
| 6,861,630 | B2 | 3/2005 | Kinouchi et al. |
| 6,868,249 | B2 | 3/2005 | Kinouchi et al. |
| 6,871,041 | B2 | 3/2005 | Takagi et al. |
| 6,889,018 | B2 | 5/2005 | Kinouchi et al. |
| 6,898,409 | B2 | 5/2005 | Tsueda et al. |
| 6,900,419 | B2 | 5/2005 | Takagi et al. |
| 7,002,118 | B2 | 2/2006 | Sone et al. |
| 7,045,749 | B2 | 5/2006 | Kinouchi et al. |
| 7,065,315 | B2 | 6/2006 | Kinouchi et al. |
| 7,079,782 | B2 | 7/2006 | Sone et al. |
| 2003/0147680 | A1 * | 8/2003 | Kawamura et al. ..... 399/333 |

(Continued)

FOREIGN PATENT DOCUMENTS

| | | | |
|---|---|---|---|
| JP | 11-249481 | A | 9/1999 |

(Continued)

OTHER PUBLICATIONS

U.S. Appl. No. 11/080,943, filed Mar. 16, 2005, Sone et al.

(Continued)

*Primary Examiner*—David M Gray
*Assistant Examiner*—Ryan D Walsh
(74) *Attorney, Agent, or Firm*—Foley & Lardner LLP

(57) ABSTRACT

A fixing apparatus according to the invention comprises an elastic member, a heating roller including a conductive metal layer on the outside of the elastic member, a pressurizing roller for supplying a predetermined pressure to the heating roller, and a driving mechanism for rotating the heating roller through the conductive metal layer, wherein a member for connecting the driving mechanism and conductive metal layer is made of material that is not twisted and deformed by the rotation of the heating roller.

8 Claims, 4 Drawing Sheets

U.S. PATENT DOCUMENTS

| | | | |
|---|---|---|---|
| 2004/0238531 | A1 | 12/2004 | Kikuchi et al. |
| 2005/0008413 | A1 | 1/2005 | Takagi et al. |
| 2005/0199612 | A1 | 9/2005 | Kikuchi et al. |
| 2005/0205559 | A1 | 9/2005 | Kikuchi et al. |
| 2005/0207804 | A1 | 9/2005 | Kikuchi et al. |
| 2005/0207805 | A1 | 9/2005 | Tsueda et al. |
| 2005/0226645 | A1 | 10/2005 | Sone et al. |
| 2006/0062585 | A1 | 3/2006 | Sone et al. |
| 2006/0062586 | A1 | 3/2006 | Sone et al. |
| 2006/0062609 | A1 | 3/2006 | Kinouchi et al. |

FOREIGN PATENT DOCUMENTS

| | | | |
|---|---|---|---|
| JP | 2000-066542 | A | 3/2000 |

OTHER PUBLICATIONS

U.S. Appl. No. 10/806,392, filed Mar. 23, 2004, Takagi et al.
U.S. Appl. No. 10/378,859, filed Mar. 5, 2003, Sone et al.
U.S. Appl. No. 09/699,472, filed Oct. 31, 2000, Kinouchi et al.

* cited by examiner

FIXING APPARATUS FOR FORMING AN IMAGE

FIELD OF THE INVENTION

The present invention relates to a fixing apparatus for fixing a developer image on a paper sheet, and in particular to a fixing apparatus using an induction heating method.

BACKGROUND OF THE INVENTION

An image forming apparatus using digital technology, for example, an electronic copier has a fixing apparatus which fixes a developer image fused by heating to a paper sheet by applying pressure.

A fixing apparatus has a heating roller for fusing developer, for example, toner, and a pressurizing roller for applying a predetermined pressure to the heating roller. A predetermined contacting width (nip width) is formed in a contacting area (nip) between the heating roller and pressurizing roller. When a paper sheet is passed through the nip, a developer image is fused by the heat from the heating roller and fixed to the paper sheet by the pressure from the pressurizing roller. Recently, an induction heater is used in which a thin film of conductive metal layer is formed on the outside of a heating roller and the conductive metal layer heated by induction heating.

In a fixing apparatus for forming a color image, for example, it is known to ensure a sufficient nip width by placing an elastic layer between a shaft and a conductive metal layer used for induction heating, in order to ensure more contact width than that in a monochrome image forming apparatus.

However, when the driving force from a shaft is transmitted to a conductive metal layer through an elastic layer, the elastic layer is twisted and the rotations of the shaft and conductive metal layer are not synchronized.

BRIEF SUMMARY OF THE INVENTION

According to an aspect of the invention, there is provided a fixing apparatus comprising:

a heating roller which includes an elastic member placed on the outside of a shaft member, and a conductive metal layer placed on the outside of the elastic member and formed cylindrically;

a pressing roller which is pressed to the heating roller by a pressing mechanism; and a driving mechanism which gives a rotating force to the conductive metal layer, and rotates the heating roller.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, embodiments of the invention will be explained in detailed with reference to the accompanying drawings.

Figure 1:
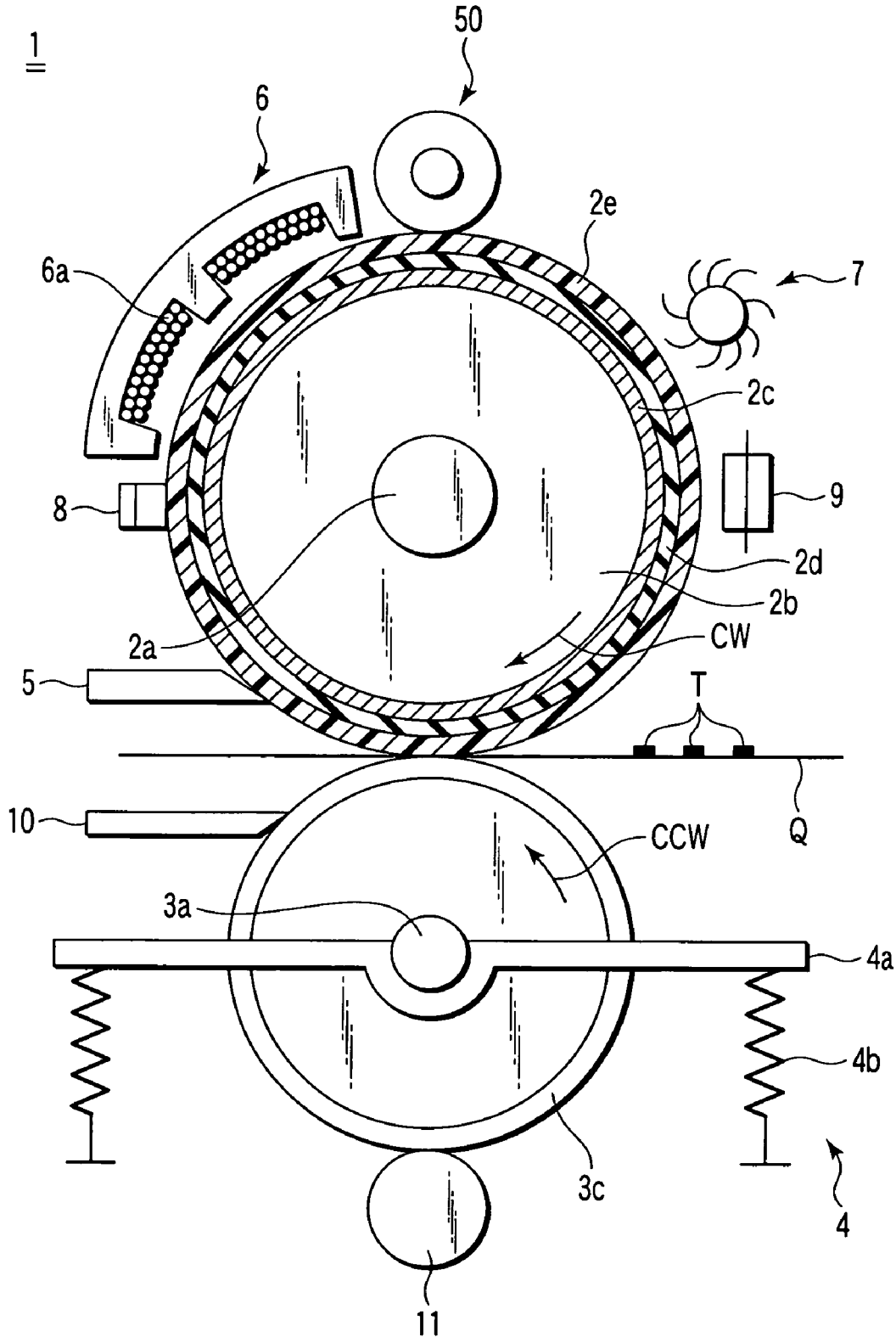
FIG. 1 is a schematic diagram showing an example of a fixing apparatus according to the invention.

FIG. 1 shows an example of a fixing apparatus 1 according to the invention.

As shown in FIG. 1, the fixing apparatus 1 comprises a heating member (heating roller) 2 for heating toner T on a paper sheet Q, a pressurizing member (pressurizing roller) 3 for applying a predetermined pressure to the heating roller 1, and a driving mechanism 50.

The heating roller 2 is fixed at a predetermined position of the fixing apparatus 1. The heating roller includes a shaft member 2*a*, a first elastic layer (hereinafter called an elastic member) 2*b* arranged around the shaft member, a conductive metal layer 2*c*, a second elastic layer 2*d*, and a mold-releasing layer 2*e*. The heating roller 2 is rotated in the direction of the arrow CW by the driving mechanism 50.

The pressing roller 3 includes a shaft member 3*a*, an elastic member (e.g., silicone rubber) 3*b* arranged on the outside of the shaft member 3*a*, and a mold-releasing layer (e.g., fluorine rubber) 3*c*. The pressurizing mechanism (pressure supplying mechanism) 4 presses the pressurizing roller 3 to the heating roller 2 by pressurizing springs 4*b* through a bearing member 4*a* connected to the shaft member 3*a*. Therefore, a nip having more than a certain width (nip width) is formed in the paper sheet P conveying direction, in the contacting part of the heating roller 2 and pressurizing roller 3. The pressurizing roller 3 is rotated in the direction of the arrow CCW, as the heating roller 2 is rotated.

In the circumference of the heating roller 2, a separating blade 5 for separating the paper sheet Q from the heating roller 2, an induction heater 6 which includes exciting coil 6*a* and a cleaning member 7 are provided in the downstream side of the rotating direction viewed from the nip between the heating roller and pressurizing roller 3. The induction heater 6 for supplying a predetermined magnetic field to the conductive metal layer 2*c* of the heating roller 2, and the cleaning member 7 for eliminating dust and offset toner adhered to the heating roller 2, are provided in this order in the rotating direction. In the longitudinal direction of the heating roller 2, a thermistor 8 for detecting the temperature of the heating roller 2, and a thermostat 9 for detecting an unusual surface temperature of the heating roller 2 and stopping supply of power for heating the heating roller 2 are arranged. The thermistor 8 is preferably provided in two or more places in the longitudinal direction of the heating roller 2. The thermostat 9 is preferably provided in at least one or more places in the longitudinal direction of the heating roller 2.

In the circumference of the pressurizing roller 3, a separating blade 10 for separating the paper sheet Q from the pressurizing roller 3, and a cleaning member 11 for eliminating toner adhered to the pressurizing roller 3, are provided.

When a not-shown exciter circuit (inverter circuit) supplies a high frequency current to the exciting coil 6*a* of the induction heater 6, the exciting coil 6*a* generates a predetermined magnetic field, and an eddy current flows in the conductive metal layer 2*c* of the heating roller 2. Then, Joule heat is generated in a resistance of the conductive metal layer 2*c*, and the heating roller 2 is heated. Namely, the heating roller 2 is induction heated by the induction heater 6.

The toner T fused by the heat from the heating roller 2 is fixed to the paper sheet Q when it is passed through the nip between the heating roller 2 and pressurizing roller 3 and given a predetermined pressed by the pressurizing roller 3.

The fixing apparatus of the invention uses induction heating to heat the conductive metal layer 2*c* formed in the outer circumference of the heating roller 2. Therefore, heat loss is minimum, energy efficiency is high, and the heating roller 2 is heated to a certain temperature in a short time.

In this embodiment, the elastic member 2*b* is foamed by the foaming rubber to which silicone rubber etc. is made to foam. The conductive metal layer 2*c* is made of aluminum, nickel or iron with a thickness of 0.5-2 mm. The second elastic layer 2*d* is made of heatproof adhesive containing silicon with a thickness of several μm to increase the contact tightness between the conductive metal layer 2*c* and mold-releasing layer. The mold-releasing layer 2*e* is formed in the outermost periphery as a fluorine resin layer (PFA or polytetrafluoroethylene [PTFE] or PFA-PTFE mixture) with a thickness of 30 μm.

Figure 2:
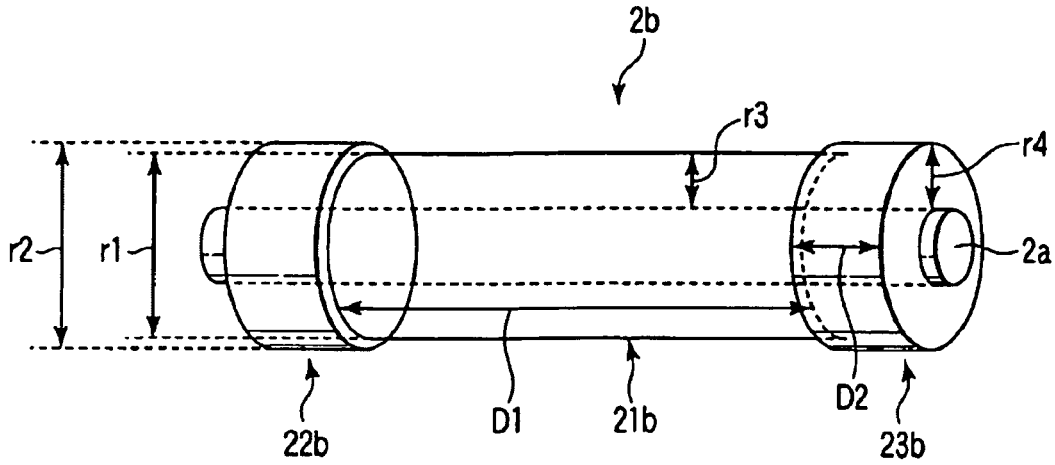
FIG. 2 is a schematic diagram showing an example of a heating roller shown in FIG. 1.

Explanation will now be given on an example of an elastic member applied to the heating roller 2 shown in FIG. 1. FIG. 2 is a schematic diagram showing a part of the heating roller 2 applicable to this embodiment.

As shown in FIG. 2, the elastic member 2*b* includes a central part 21*b* having a minimum outside diameter r1, and end parts 22*b* and 23*b* placed on both sides of the central part 21*b* and given a maximum outside diameter r2.

The central part 21*b* is formed in the axial direction with a length D1 and thickness r3. The end parts 22*b* and 23*b* are formed in the axial direction with a length D2 and thickness r4. The elastic member 2*b* is formed on the shaft member 2*a* with a certain outside diameter in the axial direction. Therefore, the thickness r3 of the central part 21*b* is less than the thickness r4 of the end parts 22*b* and 23*b*, and the thickness r4 of the end parts 22*b* and 23*b* is greater than the thickness r3 of the central part 21*b*.

With this structure, the heating roller 2 can ensure a nip width large enough to obtain a good image, in the part corresponding to the central part 21*b*, and a good image can be formed. The elastic member 2*b* has a thermal expansion coefficient higher than that of the conductive metal layer 2*c*. Thus, when the heating roller 2 is heated, the conductive metal layer 2*c* is pushed up from inside by the elastic member 2*b*, the hardness of the heating roller 2 is changed, and a sufficient nip width may not be ensured. In the configuration described above, the heating roller 2 is prevented from becoming too hard, and a sufficient nip width can be ensured.

As for the elastic member 2*b* of this embodiment with a different outside diameter in the axial direction, the entire contents of prior U.S. patent application Ser. No. 10/886,703 filed Jul. 9, 2004 are incorporated herein by reference. (The elastic layer 1*b* is disclosed in prior U.S. patent application Ser. No. 10/886,703 filed Jul. 9, 2004, the entire contents of which are incorporated herein by reference.)

First Embodiment

Explanation will be given on examples of the heating roller 2, pressurizing roller 3 and driving mechanism 50 applicable to the fixing apparatus shown in FIG. 1.

Figure 3:
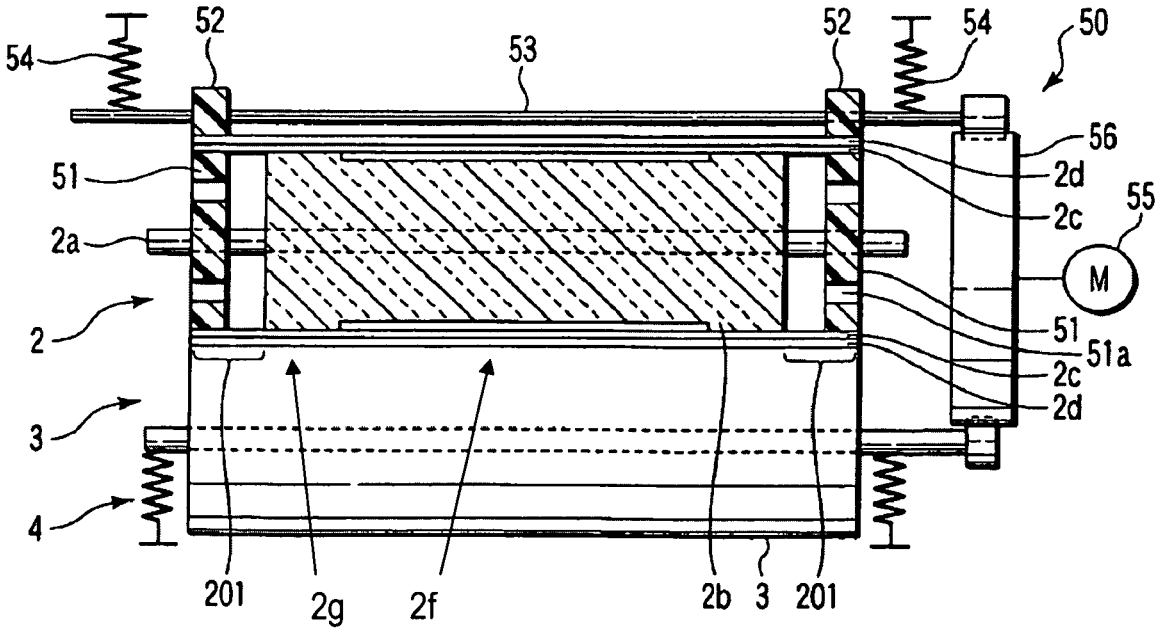
FIG. 3 is a schematic diagram explaining a first embodiment according to the fixing apparatus shown in FIG. 1.

As shown in FIG. 3, the heating roller 2 comprises burrs 201 with both ends projecting in the axial direction farther than the elastic member 2*b*. In this embodiment, the burrs 201 are formed by the conductive metal layer 2*c* and second elastic layer 2*d*. The heating roller 2 includes a paper passing area 2*f* defined as an area to pass the paper sheet Q fed between the heating roller 2 and pressurizing roller 3, in the inside of both ends of the elastic member 2*b*. The burrs 201 are placed in a paper non-passing area 2*g* formed at both ends of the paper passing area 2*f*. The paper passing area 2*f* corresponds to the central part 21*b* of the elastic member 2*b*, and the boundaries between the central part 21*b* and end parts 22*b*, 23*b* are preferably placed in the paper non-passing area 2*g*.

The driving mechanism 50 includes first members 51 which are placed inside the burrs 201 of the conductive metal layer 2*c*, second members 52 which are placed outside the burrs 201 of the heating roller 2, and a driving motor (drive) 55 which is connected to the second members 52 and supplies a rotating force to the second members 52.

The first and second members 51 and 52 are made of material that is not twisted and deformed by the rotating force from the driving motor 55.

The second members 52 are fixed to a shaft member 53 placed substantially parallel to the axial direction of the heating roller 2, and brought into contact with the heating roller 2 by a pressurizing members 54 by a predetermined pressure through the shaft member 53. Namely, the second members 52 are pressed to the first members 51 through the conductive metal layer 2*c* of the heating roller 2. Therefore, the conductive metal layer 2*c* is held between the first and second members 51 and 52.

The driving motor 55 is connected to a gear provided at one end of the shaft member 53 of the second members 52, and a gear provided one end of the shaft member 3*a* of the pressurizing roller 3, through a one-way clutch (driving force transmitter) 56. The one-way clutch mentioned here is a driving force transmission mechanism, which can transmit the driving force from a single driving motor 55 to different members. Therefore, the driving force supplied to the second members 52, or the driving force supplied to the heating roller 2 can be synchronized with the driving force supplied to the pressing roller 3.

In this configuration, the second members 52 can transmit the driving force from the driving motor 55 to the conductive metal layer 2*c*. Namely, the heating roller 2 can be rotated corresponding to the driving motor 55, and can be rotated in accordance with the rotating of the driving motor 55 when the power corresponding to the rotating force (e.g., the rotating number) from the driving motor 55 is transmitted to the conductive metal layer 2*c*.

Therefore, the fixing apparatus according to this embodiment can exactly control the speed of the outer circumference of the heating roller 2, and can form a good image.

The driving force of the driving motor 55 supplied to the pressurizing roller 3 through the one-way clutch 56 is a subsidiary force to prevent a rotation delay of the pressurizing roller 3 rotated by the driving of the heating roller 2. The invention is not limited to this. The power from the driving motor 55 may not be transmitted to the pressing roller 3.

In the example shown in FIG. 3, the first members 51 and elastic member 2*b* are spaced with a predetermined interval. The invention is not limited to this, and these members may not be spaced. Further, the first members 51 preferably have vent holes 51*a* to ventilate the air of the elastic member 2*b* (inside the heating roller 2). Even if the air included in the elastic member 2*b* is thermally expanded by the heating of the heating roller 2, the air is exhausted to the outside through the vent holes 51*a*, and the heating roller 2 is prevented from becoming too hard. A sufficient nip width can be ensured, and a good image is formed.

Further, the driving mechanism 50 (first and second members 51 and 52) of the heating roller 2 are made of a non-twisting member, the rotation of the heating roller 2 in the axial direction can be made uniform, and a partial offset is prevented and the life of the conductive metal layer 2*c* is extended.

In this configuration, the power from the driving motor 55 can be exactly transmitted to the outer circumference of the heating roller 2, and a slip between the heating roller 2 and pressurizing roller 3 can be avoided.

Second Embodiment

Explanation will be given on other examples of the heating roller, pressurizing roller and driving mechanism applicable to the fixing apparatus shown in FIG. 1.

Figure 4:
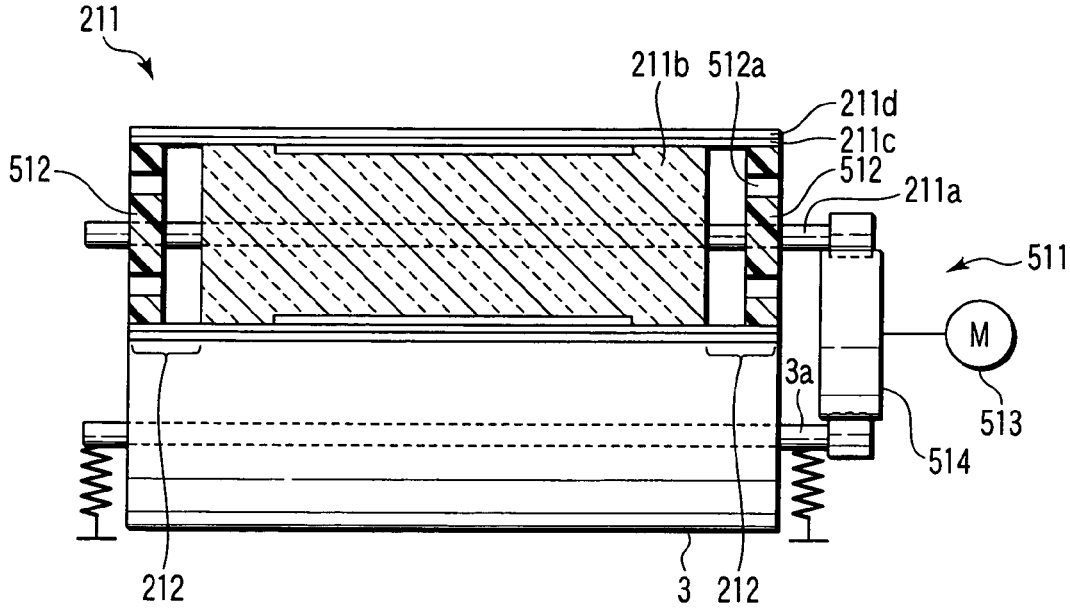
FIG. 4 is a schematic diagram explaining a second embodiment according to the fixing apparatus shown in FIG. 1.

As shown in FIG. 4, the fixing apparatus according to this embodiment includes a heating roller 211, a pressurizing roller 3, and a driving mechanism 511. The configurations of the pressurizing roller 3 and other components are the same as those explained in FIG. 1 and FIG. 2, and explanation will be omitted.

The heating roller 211 includes a shaft member 211*a*, an elastic member 211*b* placed in the circumference of the shaft member 211*a*, a conductive metal layer 211*c*, a second elastic layer 211*d*, and a mold-releasing layer (not shown). The heating roller 211 comprises burrs 212 projecting in the axial direction farther than the elastic member 211*b*, in the paper non-passing area at both ends. In this embodiment, the burrs 212 are formed by the conductive metal layer 211*c* and second elastic layer 211*d*.

The driving mechanism 511 includes a holding members 512 which are placed inside the burrs 212 of the conductive metal layer 211*c* and holds the shaft member 211*a* and conductive metal layer 211*c* of the heating roller 2, and a driving motor 513 which is connected to the shaft member 211*a* of the heating roller 2 and supplies a rotating force to the conductive metal layer 211*c* through the holding members 512.

The holding members 512 are made of material (e.g., resin) that is not twisted and deformed by the rotating force from the driving motor 55.

The driving motor 513 is connected to a gear provided at one end of the shaft member 211*a* of the heating roller 211, and a gear provided one end of the shaft member 3*a* of the pressurizing roller 3, through a one-way clutch 514. Therefore, the driving force supplied to the shaft member 211*a* of the heating roller 2, the driving force supplied to the conductive metal layer 211*c* through the holding members 512 and the driving force supplied to the pressurizing roller 3 can be synchronized.

In this configuration, the holding members 512 can transmit the driving force from the driving motor 511 to the conductive metal layer 211*c*. Therefore, the conductive metal layer 211*c* can be rotated corresponding to the rotating force (e.g., the rotating number) from the driving motor 511.

Therefore, the speed of the outer circumference of the heating roller 211 can be exactly controlled, and a good image can be formed. The power from the driving motor 513 can be exactly transmitted to the outer circumference of the heating roller 211, and slip between the heating roller 211 and pressurizing roller 3 can be prevented, and the heating roller 211 is prevented from rotating at number different from the driving motor 513.

In the example shown in FIG. 4, each holding member 512 and elastic member 211*b* are arranged with a predetermined interval. The invention is not limited to this, and these members may not be spaced. Further, the holding members 512 preferably comprise vent holes 512*a* to ventilate the air of the elastic member 211*b* (inside the heating roller 2).

Third Embodiment

Explanation will be given on other examples of the heating roller, pressurizing roller and driving mechanism applicable to the fixing apparatus shown in FIG. 1.

Figure 5:
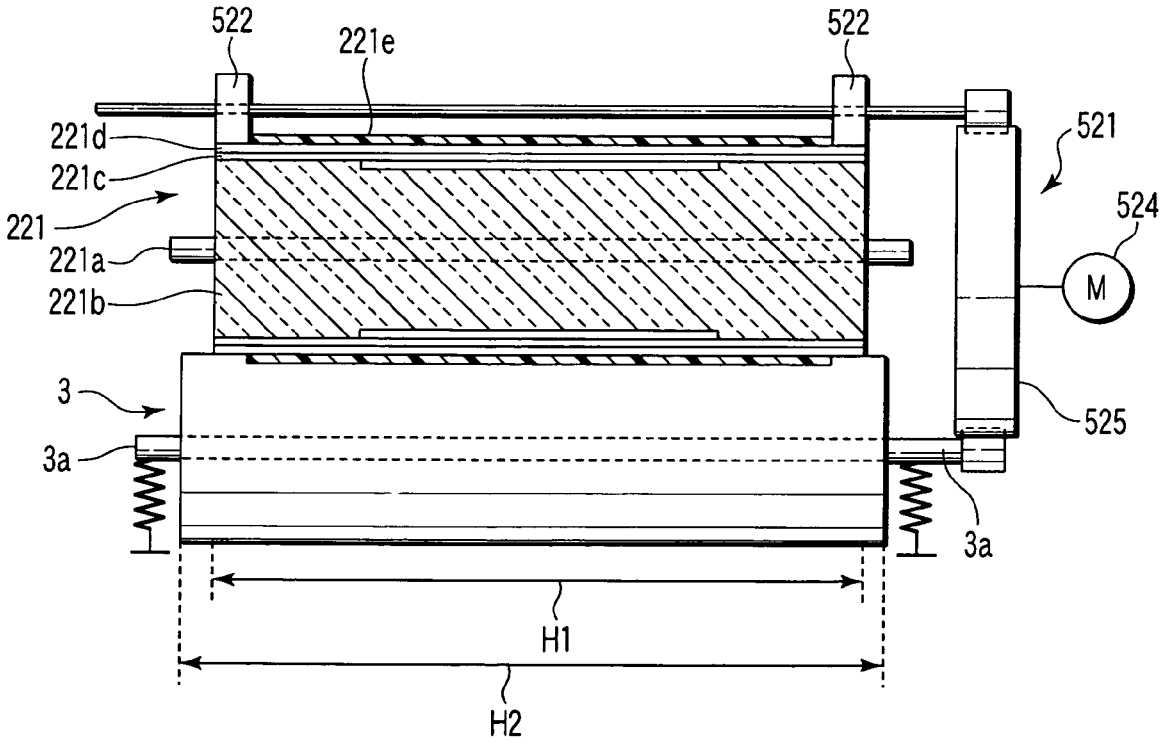
FIG. 5 is a schematic diagram explaining a third embodiment according to the fixing apparatus shown in FIG. 1.

As shown in FIG. 5, the fixing apparatus according to this embodiment includes a heating roller 221, a pressurizing roller 3, and a driving mechanism 521. The configurations of the pressurizing roller 3 and other components are the same as those explained in FIG. 1 and FIG. 2, and explanation will be omitted.

The heating roller 221 includes a shaft member 221*a*, an elastic member 221*b* placed in the circumference of the shaft member, a conductive metal layer 221*c*, a second elastic layer 221*d*, and a mold-releasing layer 221*e*. The elastic member 221*b*, conductive metal layer 221*c* and second elastic layer 221*d* have the same length in the axial direction. The mold-releasing layer 221*e* has a length inside that is less than the second elastic layer 221*b* in the axial direction. In other words, the mold-releasing layer 221*e* is placed more inside than the areas of a first member 522 of a driving mechanism 521 explained later.

The pressurizing roller 3 has a length H2 greater than a length H1 in the axial direction of the heating roller 221.

The driving mechanism 521 includes first members 522 which are both ends of the heating roller 211 and placed outside the second elastic layer 221*d* not having the mold-releasing layer 221*e* as explained before, a shaft member 523 which is held rotatably and substantially parallel to the axial direction of the heating roller 221 and fixed with the first members 522, and a driving motor 524 which is connected to the axial member 523 and supplies a rotating force to the first members 522.

The first members 522 are made of material (e.g., resin) that is not twisted and deformed by the rotating force from the driving motor 524, as the first and second members 51 and 52 explained before.

The driving motor 524 is connected to a gear provided at one end of the shaft member 523 of the first members 522, and a gear provided at one end of the shaft member 3*a* of the pressurizing roller 3, through a one-way clutch 525. Therefore, the driving force supplied to the first members 522, or the driving force supplied to the heating roller 221 can be synchronized with the driving force supplied to the pressurizing roller 3.

In this configuration, the first members 522 come into contact with the heating roller 221 in the area not having the mold-releasing layer 221*e*, and supplies a rotating force from the outside of the heating roller 221. Therefore, slip between the heating roller 221 and first members 522 can be prevented.

The first members 522 can transmit the driving force from the driving motor 524 to the conductive metal layer 221*c*.

Therefore, the speed of the outer circumference of the heating roller 221 can be exactly controlled, and a good image can be formed.

Fourth Embodiment

Explanation will be given on other examples of the heating roller, pressurizing roller and driving mechanism applicable to the fixing apparatus shown in FIG. 1.

Figure 6:
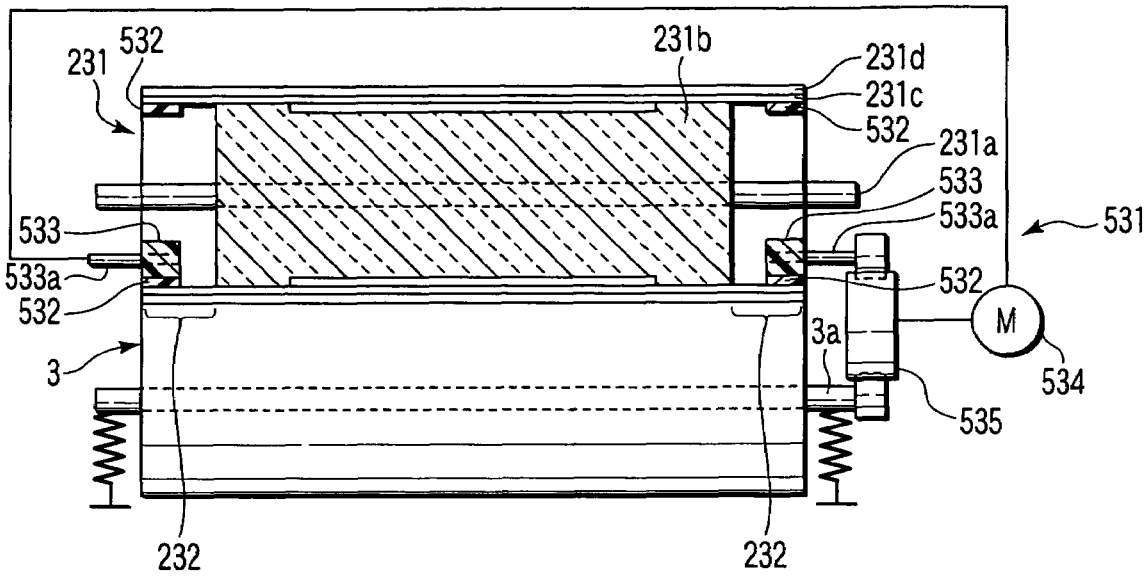
FIG. 6 is a schematic diagram explaining a fourth embodiment according to the fixing apparatus shown in FIG. 1.

As shown in FIG. 6, the fixing apparatus according to this embodiment includes a heating roller 231, a pressurizing roller 3, and a driving mechanism 531. The configurations of the pressurizing roller 3 and other components are the same as those explained in FIG. 1 and FIG. 2, and explanation will be omitted.

The heating roller 231 includes a shaft member 231*a*, an elastic member 231*b* placed in the circumference of the shaft member, a conductive metal layer 231*c*, a second elastic layer 231*d*, and a mold-releasing layer (not shown). The heating roller 231 comprises burrs 232 projecting in the axial direction farther than the elastic member 231*b*, in the paper non-passing area at both ends. In this embodiment, the burrs 232 are formed by the conductive metal layer 231*c* and second elastic layer 231*d*.

The driving mechanism 531 includes first gears 532 which are fixed to the inside of the burrs 232 placed at both ends of the heating roller 231, second gears 533 which are engaged with the first gears 532 and gives a rotating force to the conductive metal layer 231*c*, and a driving motor 534 which is connected to the second gears 533 and supplies a rotating force to the conductive metal layer 231.

Figure 7:
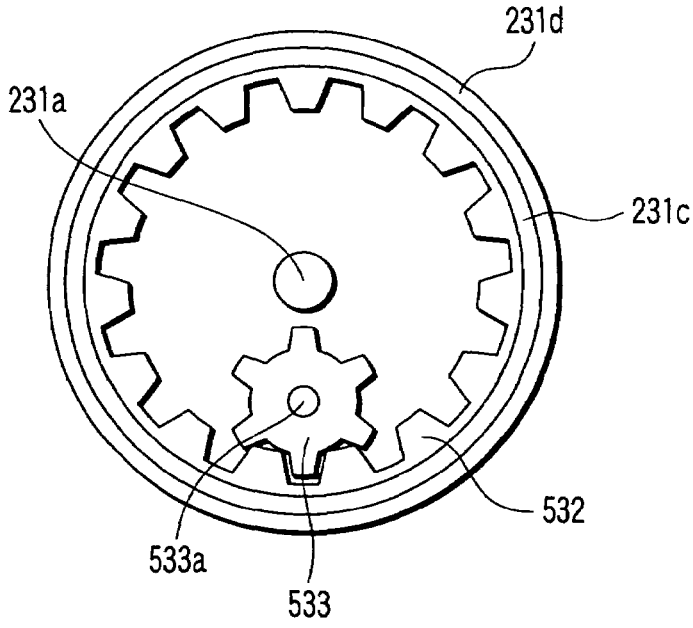
FIG. 7 is a schematic diagram of the heating roller shown in FIG. 6, viewed from the axial direction.

Explaining in detail, as shown in FIG. 7, the first gears 532 are ring-shaped gears having inside teeth in the internal circumference, and the outer circumferences are fixed to the internal circumference of the burrs 232 of the heating roller 2. The second gears 533 include outer teeth engaging with the first gears 532 in the outer circumference, and a rotation axis 533*a* at the center. The rotation axis 533*a* is rotatably held at a predetermined position. The first and second gears 532 and 533 are made of material (e.g., resin) that is not twisted and deformed by the rotating force from the driving motor 534.

The driving motor 534 is connected to a gear provided at one end of the rotation axis 533*a* of the second gear 533, and a gear provided at one end of the shaft member 3*a* of the pressurizing roller 3, through a one-way clutch 535. Therefore, the driving force supplied to the second gears 533, or the driving force supplied to the heating roller 231 can be synchronized with the driving force supplied to the pressurizing roller 3.

In this configuration, the first and second gears 532 and 533 can transmit the driving force from the driving motor 534 to the conductive metal layer 231*c*. The conductive metal layer 231*c* can be rotated corresponding to the rotating force (e.g., the rotating number) from the driving motor 534.

Therefore, the speed of the outer circumference of the heating roller 231 can be exactly controlled, and a good image can be formed. Further, the power from the driving motor 534 can be exactly transmitted to the outer circumference of the heating roller 231, and slip between the heating roller 231 and pressurizing roller 3 can be avoided.

In the example shown in FIG. 4, the first and second gears 532 and 533 are spaced with a predetermined interval. The invention is not limited to this, and the gears may not be spaced.

The invention is not limited to the above-mentioned embodiments. The invention may be embodied by modifying the components without departing from its spirit or essential characteristics. The invention may be embodied by combining the components disclosed in the above-mentioned embodiments. For example, some components may be deleted from the components disclosed in one embodiment, or some components of different embodiments may be combined.

For example, the driving force from the driving motor supplied to the pressurizing roller 3 through the one-way clutch is subsidiary force to prevent a rotation delay of the pressurizing roller 3 rotated by the driving of the heating roller 2. The invention is not limited to this. The power from the driving motor may not be transmitted to the pressurizing roller 3.

Further, as described hereinbefore, as shown in FIG. 2, by applying the elastic member 2*b* having the outside diameter of the central part 21*b* smaller than the outside diameters of the end parts 22*b* and 23*b* to the heating roller 2, a hardness change of the heating roller 2 caused by the different thermal expansion coefficient of the conductive metal layer 2*c* and elastic member 2*b* can be decreased. Therefore, the heating roller 2 is ensured to have sufficient flexibility for forming a nip width sufficient for forming a good image between the pressurizing roller 3. In this configuration, the fixing apparatus according to the above-mentioned embodiments can exactly control the speed of the outer circumference of the heating roller 2 while keeping the flexibility of the heating roller 2, and a good image can be formed. Namely, as in the fixing apparatus according to the above-mentioned embodiments, application of the driving mechanism 50 configured to rotate the heating roller 2 through the conductive metal layer 2*c* of the heating roller 2 is effective to the elastic member 2*b* as shown in FIG. 2, other elastic members having uniform outside diameter in an axial direction, members having a certain flexibility to ensure a nip width (members twisted and deformed by rotation), or a heating roller having a gap inside a conductive metal layer.

What is claimed is:

1. A fixing apparatus comprising:

a heating roller including an elastic member placed on an outside of a shaft member, and a conductive metal layer formed cylindrically and placed on the outside of the elastic member;

a pressurizing roller pressed to the heating roller; and a driving mechanism configured to give a rotating force to the conductive metal layer, and to rotate the heating roller;

wherein the conductive metal layer of the heating roller comprises burrs projecting in the axial direction farther than the elastic member at both ends; and wherein the driving mechanism includes:

first members placed inside the burrs;

second members outside the burrs, wherein the second members are configured to hold the burrs from the opposite side of the first members, and to give a rotating force to the conductive metal layer; and a drive coupled to the second members and configured to supply power to the second members.

2. The fixing apparatus according to claim 1, wherein the first and second members comprise a material configured not to twist or deform under the rotating force of the drive.

3. The fixing apparatus according to claim 1, wherein the pressurizing roller includes a shaft member coupled to the drive, and is given the same rotation as the second members.

4. The fixing apparatus according to claim 3, wherein the second member and pressurizing roller are coupled to the drive through a driving force transmission mechanism, and are provided with a driving force from the drive.

5. A fixing apparatus comprising:

a heating roller including an elastic member placed on an outside of a shaft member, and a conductive metal layer formed cylindrically and placed on the outside of the elastic member;

a pressurizing roller pressed to the heating roller; and a driving mechanism configured to give a rotating force to the conductive metal layer, and to rotate the heating roller;

wherein the heating roller includes:

a paper passing area placed at the center in an axial direction and a paper non-passing area placed at each end of the paper passing area; and a mold-releasing layer at least on the outer circumference in the paper passing area;

wherein the driving mechanism includes:

first members configured to come in contact with the paper non-passing areas of the heating roller and give a rotating force to the conductive metal layer; and a drive coupled to the first members and configured to supply power to the first members; and wherein the mold-releasing layer is not formed in an area where the first members come in contact with the heating roller.

6. The fixing apparatus according to claim 5, wherein the first members comprise a material configured not to twist or deform under the rotating force of the drive.

7. The fixing apparatus according to claim 5, wherein the pressurizing roller includes a shaft member coupled to the drive, and is provided with the same rotating force as the first members.

8. The fixing apparatus according to claim 7, wherein the first members and pressurizing roller are coupled to the drive through the driving force transmission mechanism, and are supplied with the driving force from the drive.

* * * * *